US006607265B2

(12) United States Patent
Wang et al.

(10) Patent No.: US 6,607,265 B2
(45) Date of Patent: Aug. 19, 2003

(54) INK PRINT HEAD WITH LOW FLOW RESISTANCE CENTRAL REFILLING

(75) Inventors: Chieh-Wen Wang, Hsin-Chu (TW); I-Chung Hou, Hsin-Chu (TW); Yi-Hsuan Lai, Hsin-Chu (TW); Chen-Yu Cheng, Hsin-Chu (TW)

(73) Assignee: International United Technology Co., Ltd., Chu-Pei (TW)

( * ) Notice: Subject to any disclaimer, the term of this patent is extended or adjusted under 35 U.S.C. 154(b) by 94 days.

(21) Appl. No.: 09/683,461

(22) Filed: Jan. 3, 2002

(65) Prior Publication Data

US 2002/0122089 A1 Sep. 5, 2002

(30) Foreign Application Priority Data

Jan. 12, 2001 (TW) ..... 90100702 A

(51) Int. Cl.[7] ..... B41J 2/14
(52) U.S. Cl. ..... 347/94
(58) Field of Search ..... 347/42, 40, 44, 347/47, 50, 87, 94, 48, 65; 756/307.6

(56) References Cited

U.S. PATENT DOCUMENTS 5,463,411 A * 10/1995 Wehl ..... 347/65
5,538,586 A * 7/1996 Swanson et al. ..... 156/307.6
6,039,439 A * 3/2000 Komplin et al. ..... 347/65
6,188,414 B1 * 2/2001 Wong et al. ..... 347/42
6,273,553 B1 * 8/2001 Kim et al. ..... 347/48

* cited by examiner

*Primary Examiner*—Anh T. N. Vo
(74) *Attorney, Agent, or Firm*—Winston Hsu

(57) ABSTRACT

An ink print head has an ink container for storing fluid, a chip installed at a bottom of the ink container having a central slot for passing fluid, and a dry film formed on the chip having a plurality of ink chambers. The ink print head also has a nozzle plate formed below the dry film, a middle portion of the nozzle plate protruding above the nozzle plate so as to form a central refill chamber, a plurality of nozzles corresponding to the ink chambers of the dry film, and a plurality of heaters set on the chip for heating fluid inside the ink chambers so that the fluid can be ejected from the nozzles of the nozzle plate. The fluid inside the ink container will flow through the central slot into the central refill chamber and then into the ink chambers.

4 Claims, 9 Drawing Sheets

INK PRINT HEAD WITH LOW FLOW RESISTANCE CENTRAL REFILLING

BACKGROUND OF INVENTION

1. Field of the Invention

The present invention relates to an ink print head. More specifically, the present invention discloses an ink print head with low flow resistance central refilling, which provides a wide fluidflowing channel so as to reduce the flow resistance.

2. Description of the Prior Art

Inkjet printers provide high level printing quality for a reasonable price. They have become a welcome printing device in the information age. Striving for higher performance, higher printing quality and quicker printing speed has become a goal of modern research.

Please refer to FIG. 1. FIG. 1 is a diagram of a prior art ink print head 10 of the inkjet printer. During a printing operation, the inkjet printer ejects fluid out from the ink print head 10 onto a printing paper 11. The ink print head 10 comprises an ink container 12 for storing fluid. An ink ejection module 16 is installed on a bottom 14 of the ink container 12 for ejecting the ink out onto the printing paper 11. The printing paper 11 (only a portion is shown in FIG. 1) is set under the ink print head 10. There is a fixed distance 13 between the printing paper 11 and the ink ejection module 16.

Please refer to FIG. 2 to FIG. 4 for a further explanation of the structure of the ink ejection module 16. FIG. 2, FIG. 3, and FIG. 4 offer a perspective view, a structural diagram, and a cross-sectional view along hatched line 4—4 of FIG. 2, of the ink ejection module 16, respectively. Please note that, the figures display the ink ejection module 16, which is set on the bottom 14 of the ink container 12. Therefore, FIG. 2, FIG. 3, and FIG. 4 offer a view seen from the bottom of the ink print head 10. In other words, the upper portions of the figures represent the lower portion of the ink print head 10. For simplicity, the ink container 12 is only partially drawn on the figures. A plurality of nozzles 18 is set on the ink ejection module 16, which ejects fluid out onto the printing paper 11 (the printing paper is not shown in FIG. 2 to FIG. 4). The ink ejection module 16 comprises a nozzle plate 20, a dry film 22, and a chip 24, each stacked up. A central slot 30 is set in the middle portion of the chip 24 for passing fluid. A plurality of heaters 32 (providing thermal resistance) is set on the chip 24. In addition, the dry film 22 is stacked on the chip 24. The dry film 22 has a plurality of etching holes, so as to form channels 28 and ink chambers 34 on the chip 24. The nozzle plate 20 is stacked on the dry film 22, yet the nozzles 18 penetrate the nozzle plate 20.

The principle of the prior art ink print head 10 ink ejection module 16 can be described as below. The fluid flows out from the central slot 30 of the chip 24,through the channel 28 that is formed by the dry film 22, and then into the ink chamber 34 which also formed by the dry film 22. The heater 32 of the chip 24 is set corresponding to the ink chambers 34 for heating the fluid inside the ink chambers 34. The fluid then ejects out from the nozzles 18 of the nozzle plate 20 to print on the printing paper 11. A path 35 that fluid flows out from the ink container 12 and ejects out from the nozzles 18 is shown in FIG. 4.

As told before, printing speed requirements of ink printers are increasing constantly. That means the fluid will eject out from the nozzles more and more frequently. In order to resupply the quickly-consumed fluid inside the ink chamber 34, the fluid must able to flow out from the ink container 12, through the channel 28, and into the ink chamber 34 quickly. However, the channel 28 of the prior art ink ejection module 16 is formed only by the thickness of the dry film 22. The thickness of the dry film 22 is about 25 $\mu$m. The channel 28 formed by the dry film 22, covering the whole flowing channel from the central slot 30 to the ink chamber 34, is too narrow and too long (about 2 mm). The channel causes a large fluid resistance, so that fluid is unable to flow from the central slot 30 into the ink chamber 34 quickly. Therefore, the prior art ink print head 10 is unable to print quickly.

SUMMARY OF INVENTION

It is therefore a primary objective of the claimed invention to provide an ink print head with a low flow resistance ink ejection module, overcoming the limitation of the prior art.

The claimed invention, briefly summarized, discloses an ink print head with a low flow resistance ink ejection module. The ink print head has an ink container for storing fluid, a chip installed at a bottom of the ink container having a central slot for passing fluid, and a dry film formed on the chip having a plurality of ink chambers. The ink print head also has a nozzle plate formed below the dry film, a middle portion of the nozzle plate protruding above four sides of the nozzle plate so as to form a central refill chamber, and a near two edges of the nozzle plate having a plurality of nozzles corresponding to the ink chambers of the dry film. In addition, the ink print head also includes a plurality of heaters set on the chip for heating fluid inside the ink chambers so that the fluid can be ejected from the nozzles of the nozzle plate. When operating, fluid inside the ink container will flow through the central slot into the central refill chamber and then into the ink chambers.

It is an advantage of the claimed invention that the central refill chamber increases the capacity and the flow rate of the flowing channel, therefore decreasing the fluid flow resistance. The consumed fluid inside the ink chamber is resupplied quickly, achieving high printing speed.

These and other objectives of the present invention will no doubt become obvious to those of ordinary skill in the art after reading the following detailed description of the preferred embodiment which is illustrated in the various figures and drawings.

DETAILED DESCRIPTION

Figure 1:
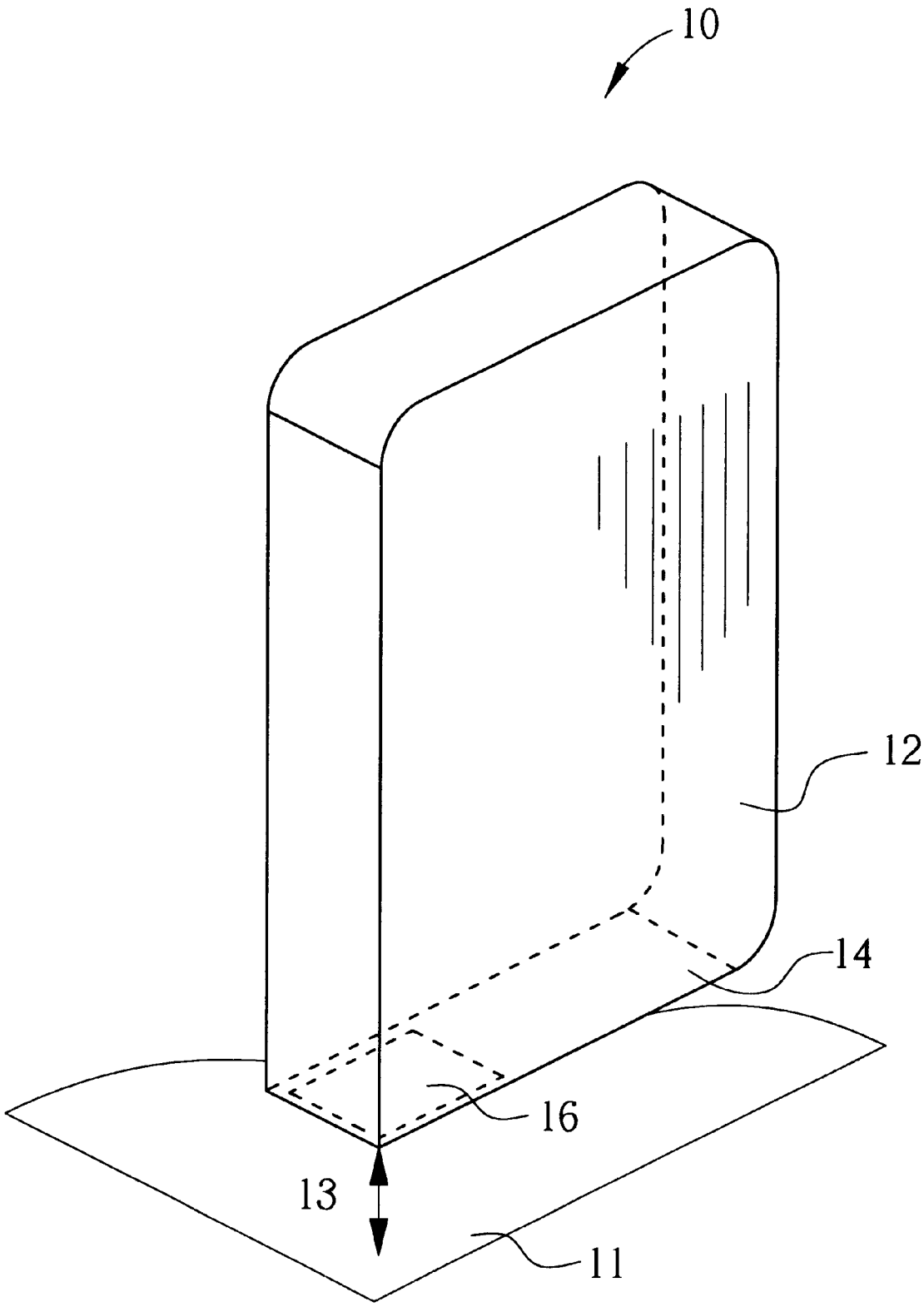
Fig. 1 Prior art
FIG. 1 is a diagram of a prior art ink print head of the inkjet printer.
Figure 2:
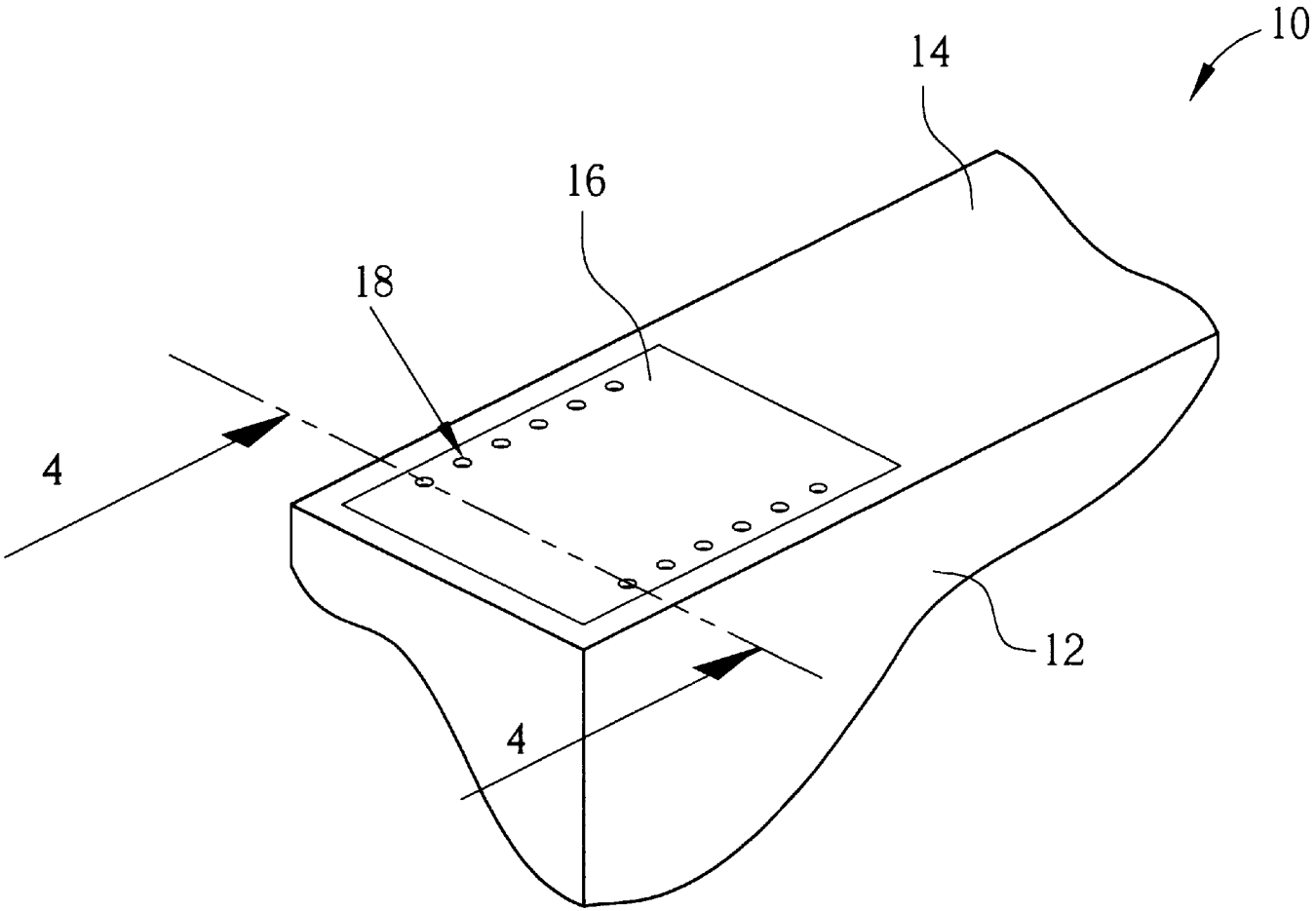
Fig. 2 Prior art
FIG. 2 is a perspective view of a prior art ink ejection module.
Figure 3:
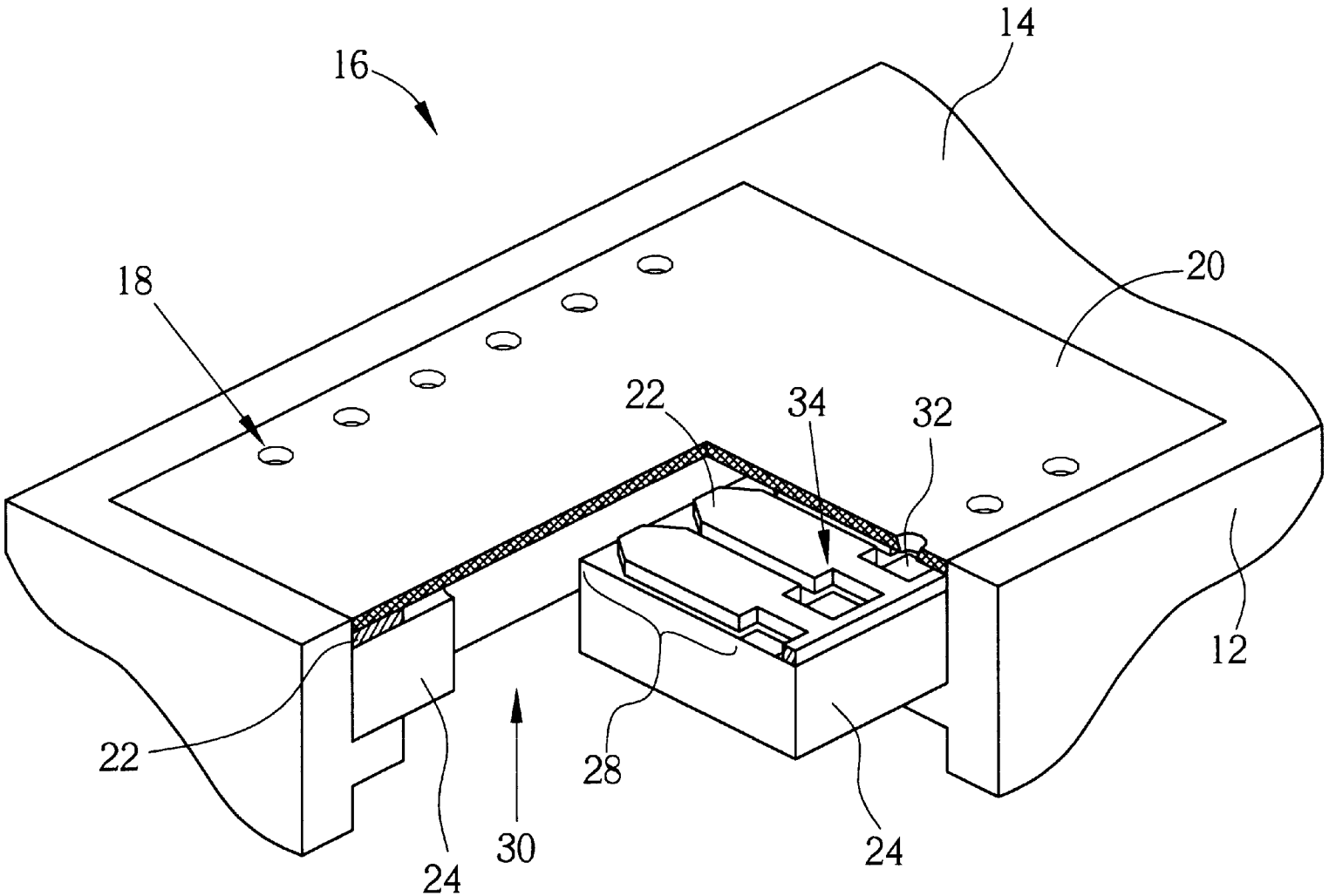
Fig. 3 Prior art
FIG. 3 is a structural drawing diagram of a prior art ink ejection module.
Figure 4:
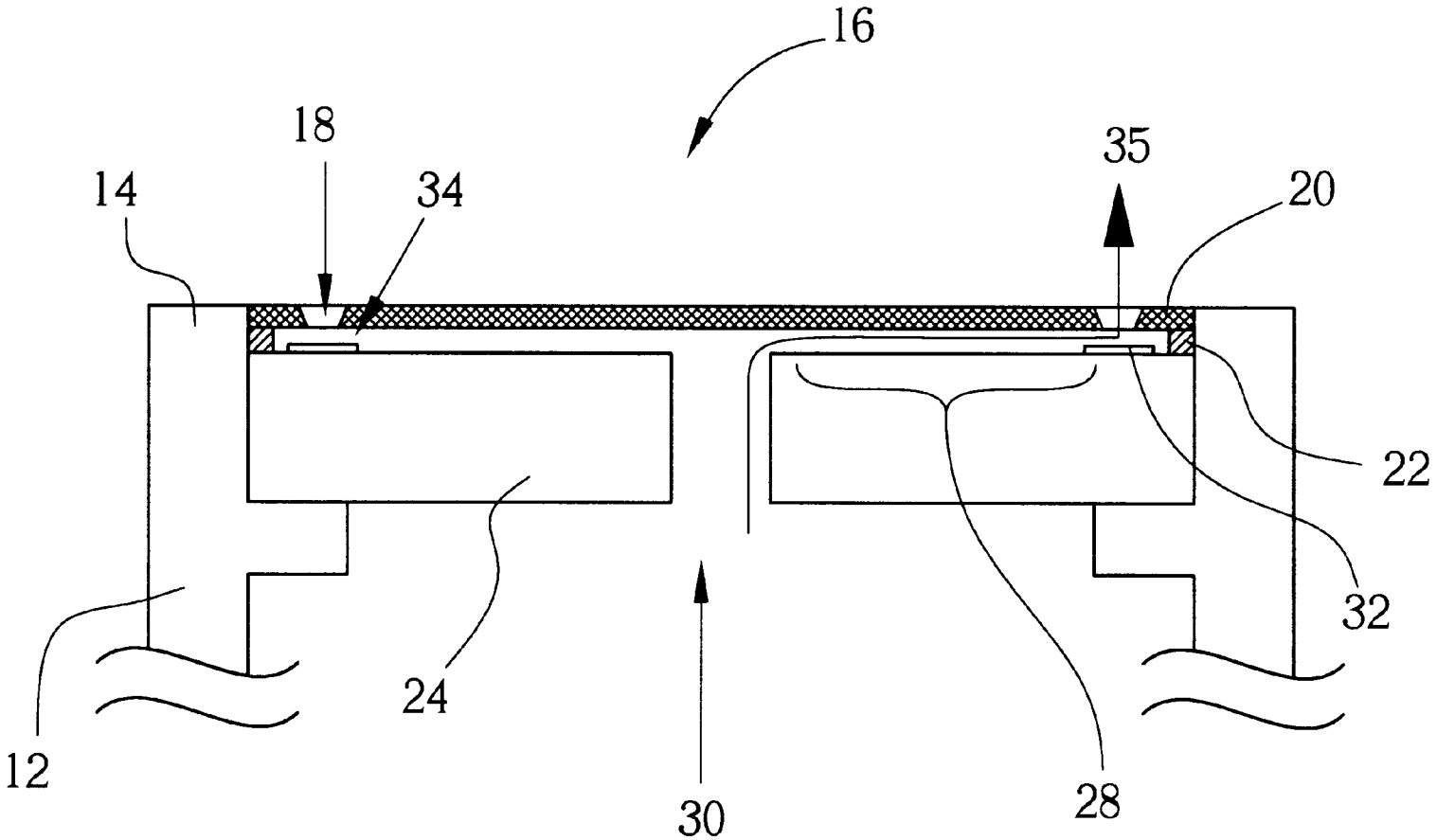
Fig. 4 Prior art
FIG. 4 is a cross-sectional view of FIG. 2, of a prior art ink ejection module 16
Figure 5:
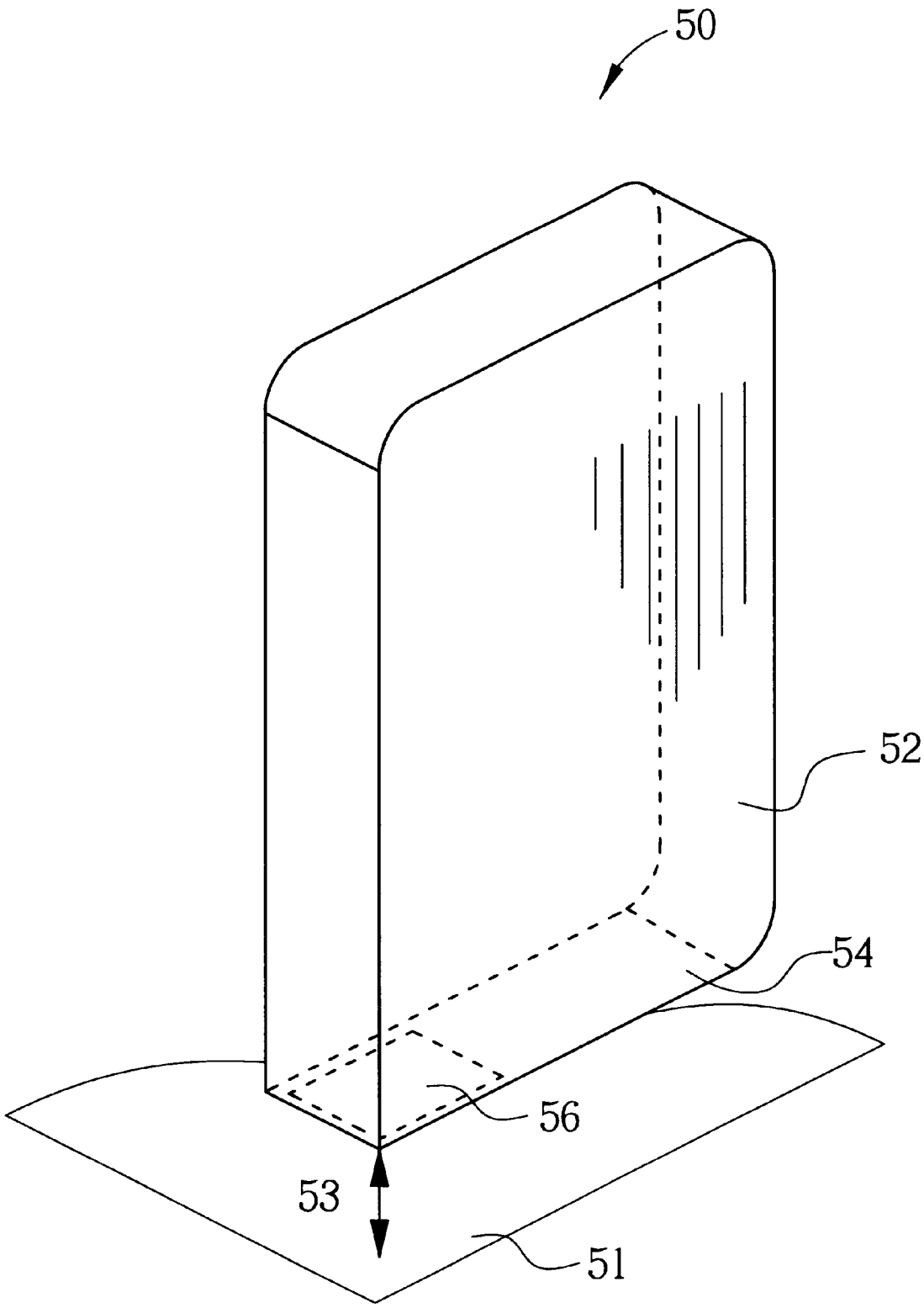
FIG. 5 is a diagram of a present invention ink print head.
Figure 6:
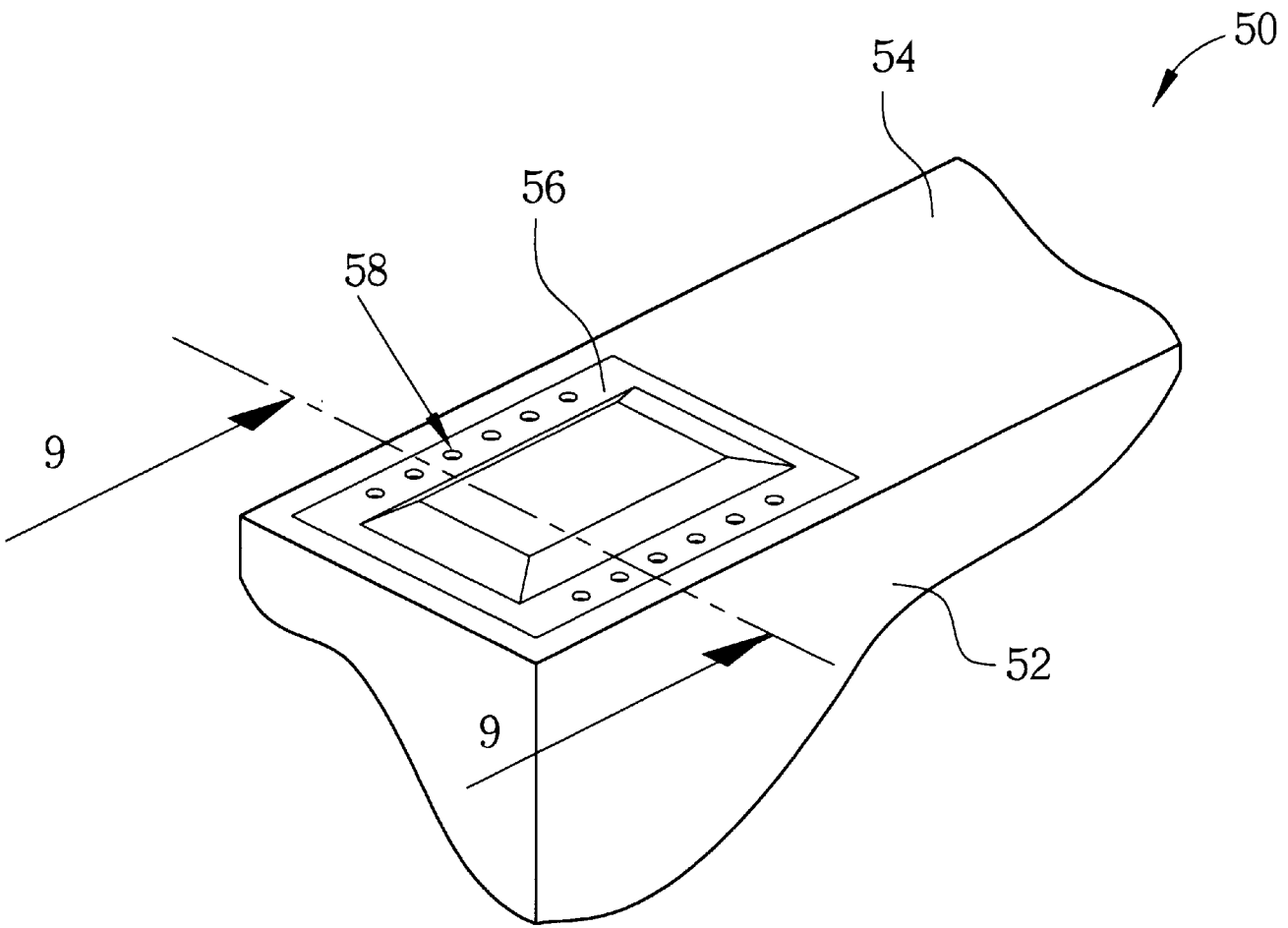
FIG. 6 is a perspective view of the present invention ink ejection module.
Figure 7:
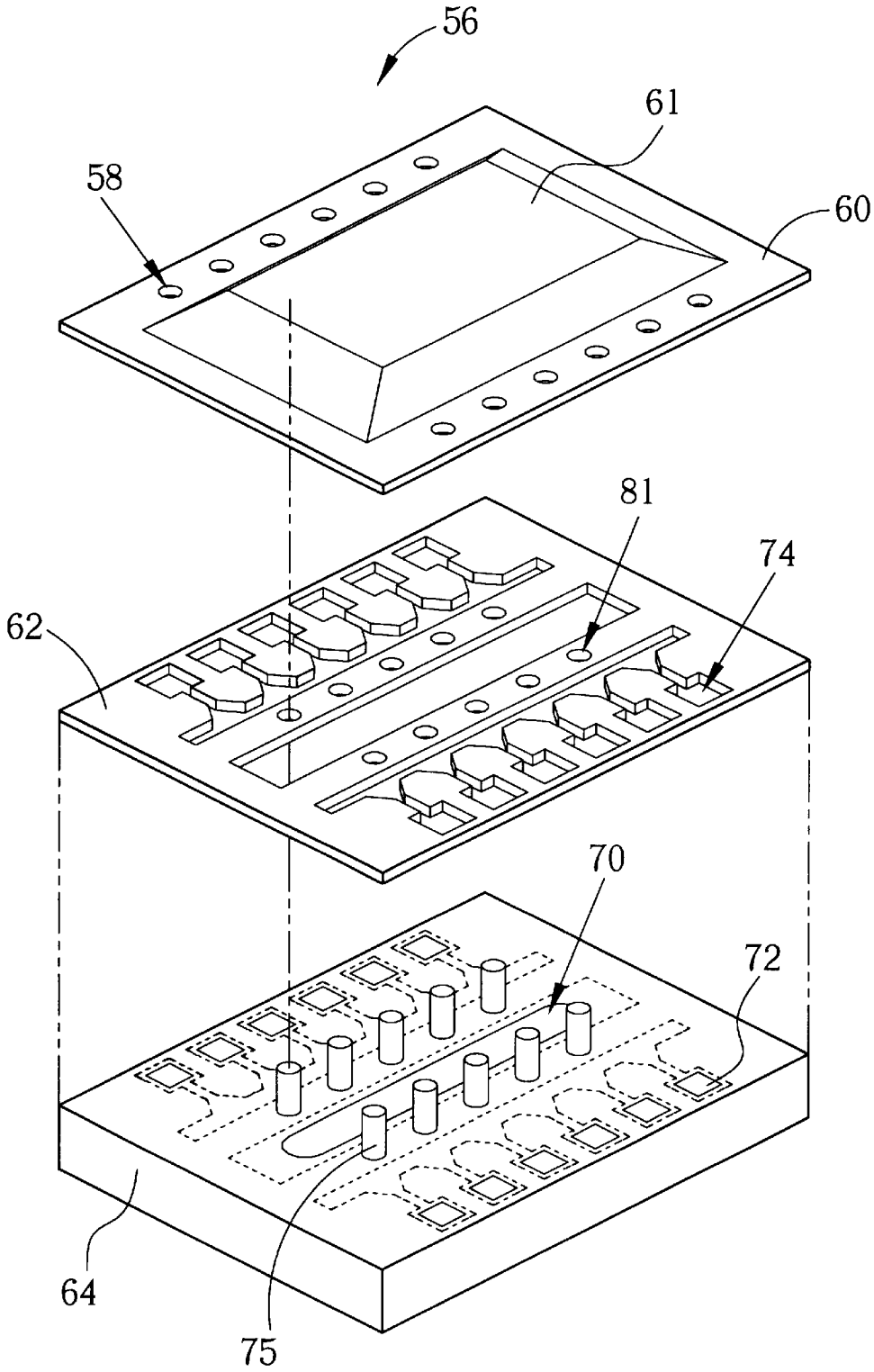
FIG. 7 is a component diagram of the present invention ink ejection module.
Figure 8:
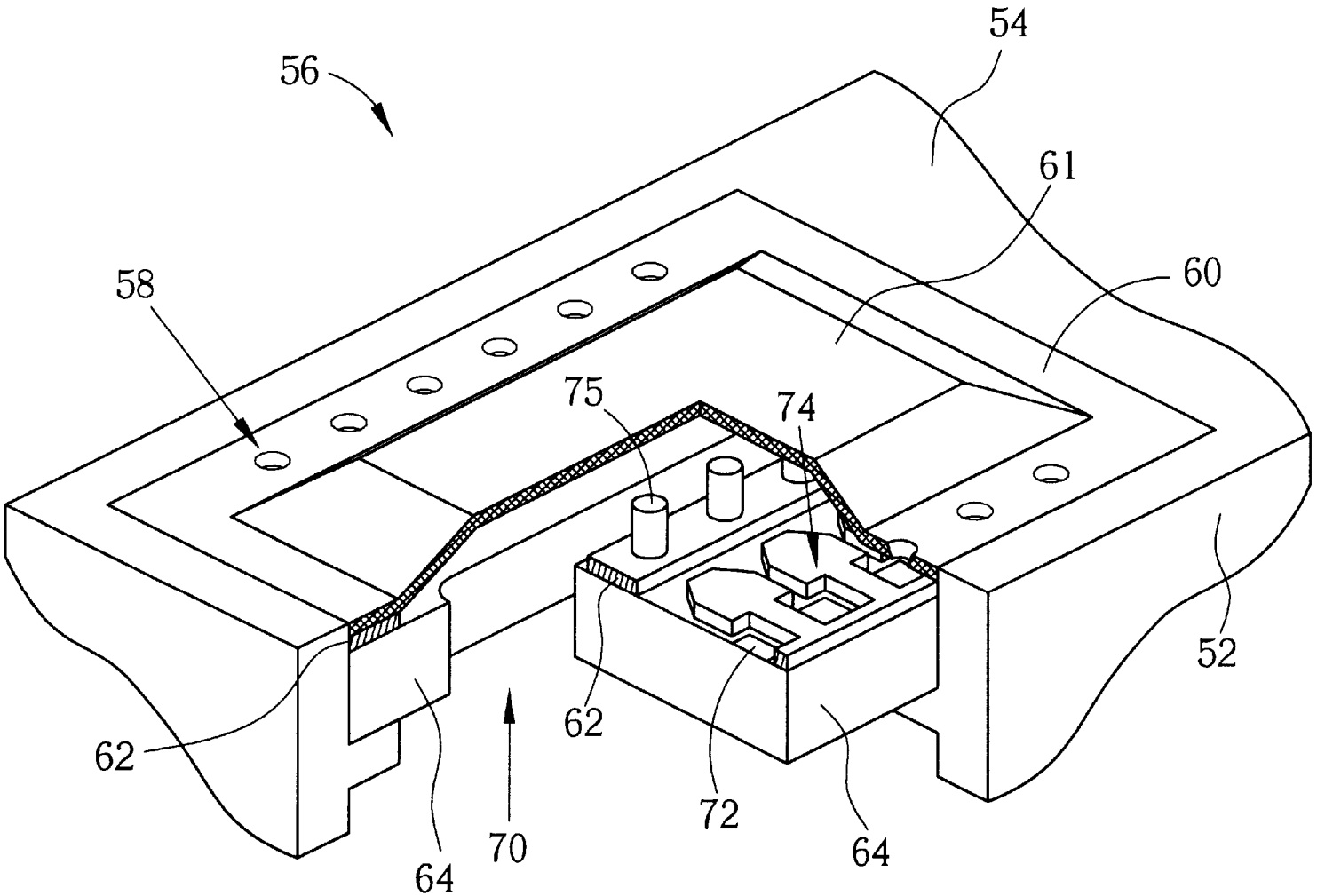
FIG. 8 is a structural drawing diagram of the present invention ink ejection module.

Please refer to FIG. 5. FIG. 5 is a diagram of a present invention ink print head 50.

The ink print head 50 comprises an ink container 52. An ink ejection module 56 is set on a bottom 54 of the ink container 52 for ejecting out the fluid from the ink container 52 to a printing paper 51. The printing paper 51 is set under the ink prink head 50. There is a fixed distance 53 between the ink ejection module 56 and the printing paper 51.

Please refer to FIG. 6 to FIG. 9. FIG. 6 to FIG. 9 offer a perspective view, a component diagram, a structure drawing diagram, and a cross-section view along hatched line 99 shown in FIG. 6 of the present invention ink ejection module 56, respectively. Please note that, in order to clearly display the ink ejection module 56, which is set on the bottom 54 of the present invention ink container 52, the figures of FIG. 6 to FIG. 9 are viewed from the bottom of the ink print head 50. In other words, the upper portion of FIG. 6 to FIG. 9 represents the lower porting of the ink print head 50. For clarity, the ink container 52 in the figures is only partially drawn or omitted altogether. The surface of the ink ejection module 56 has a plurality of nozzles 58 (the 12 nozzles shown in FIG. 6 and FIG. 7 stand for these nozzles). The fluid is ejected from the nozzles 58 to the printing paper 51 during the printing process.

The ink ejection module 56 comprises a three-layer structure: a nozzle plate 60, a dry film 62, and a chip 64. A central slot 70 is set in middle portion of the chip 64 for passing fluid. A plurality of heaters 72 is set on the chip 64. Further, a plurality of short columns 75 is also set on the surface of the chip 64. The dry film 62 comprises a plurality of etching ink chambers 74 and penetrating holes 81 corresponding to the position of the short columns 75. In the FIG. 7 component diagram, the dashed lines on the chip 64 represent the positions of the dry film 62 etching holes corresponding to the chip 64. A middle portion 61 of the present invention nozzle plate 60 protrudes above the nozzle plate 60 on four sides. Two edges of the nozzle plate 60 have a plurality of nozzles 58. With the nozzle plate 60, the dry film 62, and the chip 64 stacked up, the short columns 75 of the chip 64 pass through the holes 81 of the dry film 62 and connect with the protruding middle portion 61 of the nozzle plate 60. The protruding middle portion 61 of the nozzle plate 60 will form a central refill chamber 83 between the nozzle plate 60 and the dry film 62, supported by the short columns (please refer to FIG. 9). As for the two smooth edges of the nozzle plate, which have a plurality of the nozzles, they are stacked close against the surface of the dry film 62. This forms the shape of the ink chamber 74 with the dry film 62 etching holes.

Figure 9:
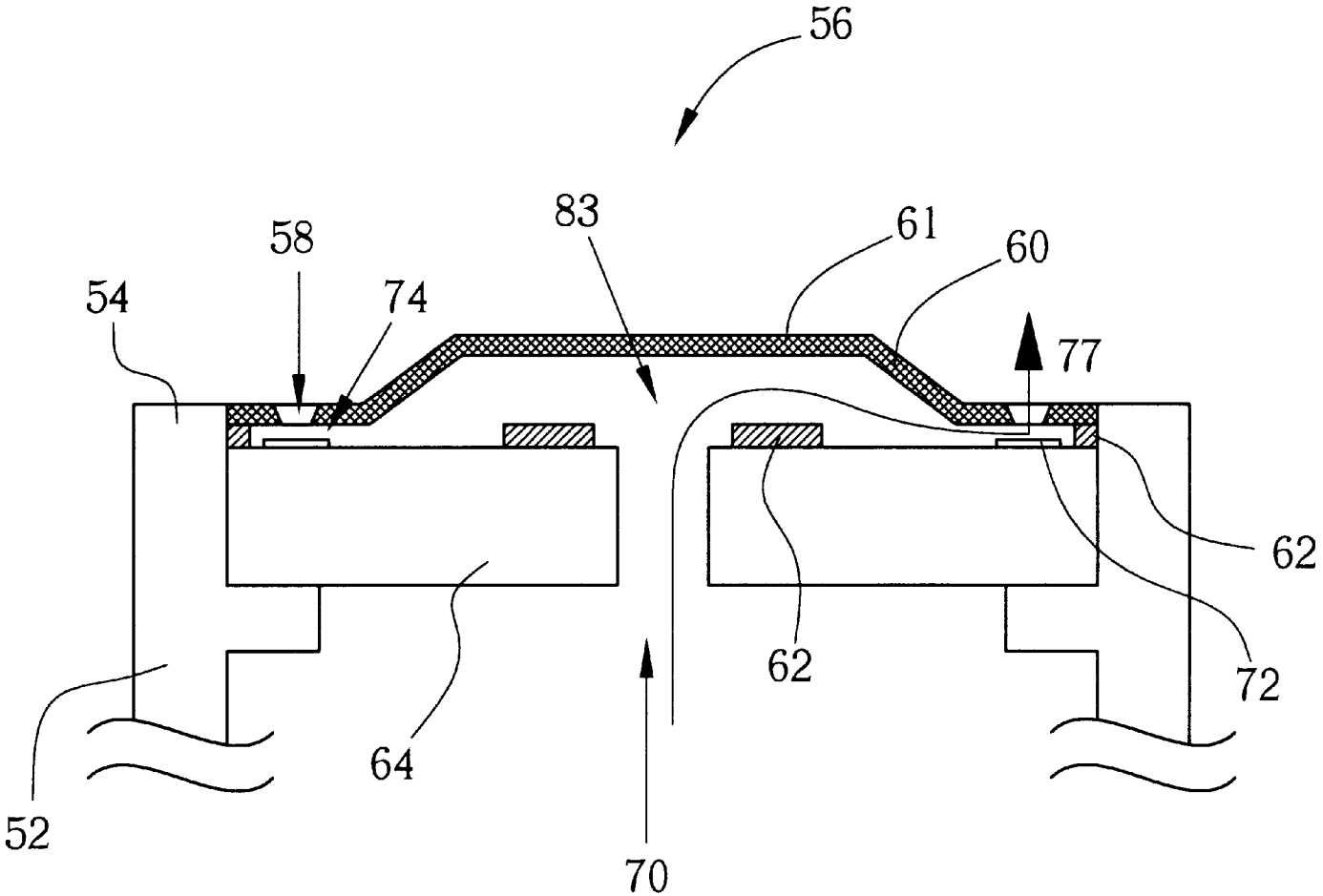
FIG. 9 is a cross-section view of FIG. 6, of the present invention ink ejection module.

The principle of the present invention ink print head 50 is described as below. The fluid inside the ink container 52 flows out from the central slot 70 which in the middle of the chip 64, into the ink ejection module 56. The fluid then passes through the central refill chamber 83 and flows into the ink chamber 74. The heater 72 of the chip 64, which is set corresponding to the ink chamber 74, heats the fluid inside the ink chamber 74. Next, the fluid ejects out from the nozzles 58, achieving the purpose of ink printing. A path that the fluid flows out from the central slot 70 and ejects out from the nozzles 58 is shown in FIG. 9. Please notice that, in the present invention, the fluid flows into the ink ejection module 56 and then arrives into the ink chamber 74 after passing through the central refill chamber 83. The central refill chamber 83 is formed by the protruding middle portion 61 of the nozzle plate 60. Therefore, the central refill chamber 83 is able to increase the capacity and the flow rate of the flowing channel through which the fluid flows from the central slot 70 into the ink chamber 74, decreasing the fluid flow resistance. The consumed fluid inside the ink chamber 74 can be resupplied quickly, achieving the purpose of quick ink printing.

In contrast to the prior art ink print head only using the dry film 22 to form the narrow flowing channel, the ink ejection module 56 of the present invention ink print head 50 uses the protruding middle portion 61 of the nozzle plate 60 to form the wide flowing channel. This ensures that the fluid can flow quickly in the present invention ink ejection module 56 with low flow resistance, achieving the purpose of high printing speed. The height of the present invention central refill chamber 83 (the vertical distance between the middle portion 61 of the nozzle plate and the dry film 62) can be set between 50 $\mu$m and 500 $\mu$m according to requirements. This distance is much greater than that of the prior art, which uses the dry film thickness (25 $\mu$m) to form the flowing channel. The fixed distance 53 between the ink ejection module 56 and the printing paper 51 (please refer to FIG. 5) is always set to be 1 mm, so there is enough space to set the protruding central refill chamber 83 in the ink ejection module 56. Further, the flowing channel of the prior art, formed by the dry film 22, is too long (about 2 mm) to cover the whole path from the central slot 30 to the ink chamber 34. Therefore, the flowing resistance is unable to be reduced. In contrast, the present invention flowing channel is formed by the central refill chamber 83, so the path in the dry film 62 is short (please refer to FIG. 9). Therefore the flowing resistance is effectively reduced. In addition to setting the short columns 75 on the chip 64 for support, the reinforced structure of the central refill chamber 83 can also form a solidified structure on the dry film 62 surface (the surface near the nozzle plate) using spot glue. Thus, ample support is given to the central refill chamber 83 by the protruding middle portion 61.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink print head comprising:

an ink container for storing fluid;

a circuit board installed at a bottom of the ink container having a central slot for passing fluid;

a dry film formed on the circuit board having a plurality of injection chambers;

a nozzle plate formed below the dry film, a middle portion of the nozzle plate protruding outwardly at least two sides of the nozzle plate so as to form an ink chamber, the two sides of the nozzle plate having a plurality of nozzles corresponding to the injection chambers of the dry film; and a plurality of heaters set on the circuit board for heating fluid inside the injection chambers so that the fluid is capable of being injected from the nozzles of the nozzle plate;

wherein fluid inside the ink container will flow through the central slot into the ink chamber and then into the injection chambers.

2. The ink print head of claim 1 further comprising a plurality of short columns inside the ink chamber for connecting the circuit board and the nozzle plate.

3. The ink print head of claim 1 wherein the middle portion of the nozzle plate protrudes below four sides of the nozzle plate, and the four sides of the nozzle plate are fixed on the dry film.

4. The ink print head of claim 1 wherein a distance between the middle portion of the nozzle plate and a lower surface of the dry film is set between 50 $\mu$m and 500 $\mu$m.

* * * * *